United States Patent [19]

Domazer et al.

[11] 4,071,229

[45] Jan. 31, 1978

[54] VACUUM REVOLVING CYLINDRICAL FURNACE

[75] Inventors: Hans-Günter Domazer, Essen-Stadtwald; Horst Eggert, Essen-West, both of Germany

[73] Assignee: Th. Goldschmidt AG, Germany

[21] Appl. No.: 781,106

[22] Filed: Mar. 25, 1977

[30] Foreign Application Priority Data

Apr. 10, 1976 Germany ..... 2615767

[51] Int. Cl.[2] ..... C21B 11/06

[52] U.S. Cl. ..... 266/173; 266/905

[58] Field of Search ..... 75/27; 266/173, 905

[56] References Cited

U.S. PATENT DOCUMENTS 2,915,384 12/1959 Walsh ..... 266/905

*Primary Examiner*—Gerald A. Dost

*Attorney, Agent, or Firm*—James E. Bryan

[57] ABSTRACT

This invention relates to a vacuum rotatable tubular furnace for metallothermal reactions comprising an outer housing adapted to be evacuated and having one end thereof a closable filler cap, and a vacuum-tight passage for a shaft on the other end, rotatable tube means in said outer housing, said tube means being open on an end thereof facing said filler cap, and having a shaft connected to the other end of said tube and extending through said housing, a cylindrical reaction chamber mounted in said rotatable tube means symmetrically to the longitudinal axis of the latter, and being detachably connected thereto, said reaction chamber being narrowed on a filling end thereof to a tube having a small lumen and being closed at the other end thereof, a cylindrical evaporation chamber mounted in the area of the filling end of the reaction chamber and being adapted to contain metal effecting a metallothermal reaction, said evaporation chamber having an opening on an end thereof facing said filler cap, heating means on said rotatable tube means at least within the area of the cylindrical reaction chamber, means for evacuating the rotatable furnace, and drive means for rotating said rotatable tube means.

8 Claims, 1 Drawing Figure

VACUUM REVOLVING CYLINDRICAL FURNACE

Figure 1:
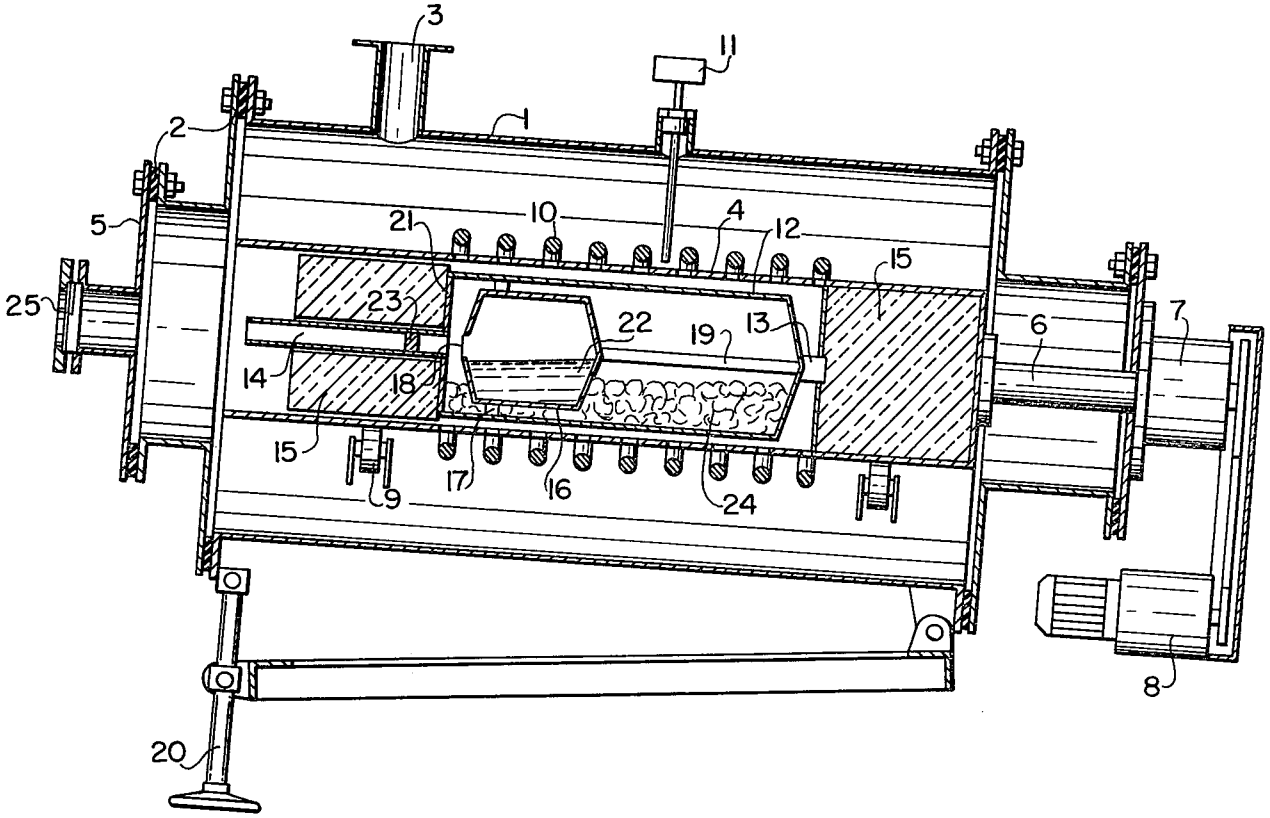

The present invention relates to a vacuum rotary cylindrical furnace for use in metallothermal reactions.

Designated as metallothermal reactions are those reactions in which metallic compounds are reduced by means of another base metal. Employed as reducing metals are particularly sodium, potassium, magnesium, calcium, and aluminum; in rare cases also lanthanum or cerium misch metal.

Particularly well known as an example of a metallothermal reaction is the reaction of aluminum power with iron oxide. For this purpose, granular aluminum is mixed in a reaction crucible with iron oxide powder and ignited at one place. The strongly exothermic reaction spreads over the entire reaction mixture, whereby the aluminum reduces the iron oxide to iron and changes into aluminum oxide. Because of the large quantities of heat liberated, the iron collects at the bottom of the crucible in a molten state, and the aluminum oxide forms a liquid slag under the conditions of the reaction, which slag — because of the lower specific weight and the lack of wettability thereof — collects above the molten iron as a separate phase.

Manufactured according to this principle since the turn of the century are low-carbon alloys, such as, for example, alloys based on ferrotitanium, ferrochromium, ferromanganese, or ferrovanadium. It is also possible to obtain metallic chromium from chromium oxide.

Particularly well suited for metallothermal reactions are calcium and magnesium which react in a similar manner. Because of their lower boiling point it is possible, in suitable apparatuses, to permit gaseous calcium or magnesium to act upon the reactants to be reduced.

In most recent times, the manufacture of rare earth-cobalt alloys by the action of calcium upon mixtures of oxides of the rare earths and cobalt has again assumed topical importance because of the specific permanent-magnetic properties of these alloys.

Thus, German Pat. No. 2,303,697, discloses a process for making pulverulent or easily pulverizable alloys of the rare earths with cobalt, in which process mixtures of finely-divided oxides of the rare earths and of cobalt are co-reduced with gaseous calcium at temperatures of approximately 1,000° to 1,400° C and at a presure of $\leqq 10^{-2}$ Torr, the resultant reaction product is mechanically comminuted to a particle size of $<100\mu m$, and the RE-cobalt alloy formed is separated by a treatment with aqueous acid, or magnetically, or by extraction processes of secondary reaction products.

Disclosed in this patent is an apparatus for carrying out the process, which apparatus is a furnace closed off against the external atmosphere, this furnace comprising a reaction chamber, preferably centrally located, which is evacuated by means of a pump to a pressure of $\leqq 10^{-2}$ to $10^{-3}$ Torr and which contains two separately heatable, upwardly open reaction vessels. In one reaction vessel, there is generated the calcium vapor required for the reduction and in the other reaction vessel there are present pressed articles of the mixture of the oxides of the rare earths and of cobalt. Under the conditions of the reaction, the gaseous calcium reacts with the mixtures pressed to the aforementioned green articles with the formation of the desired alloys in pulverulent or at least pulverizable form. According to the same process principle and in an apparatus such as the one described above, other metallic oxides also may be reduced, such as, for example, chromic oxide, zirconium oxide, or titanium oxide, but this enumeration should not be considered as being exhaustive.

In carrying out the metallothermal process in the aforementioned apparatus it has been formed to be a disadvantage that the calcium vapor must through-reduce the molded articles from the outside toward the inside. Available to the calcium vapor is, therefore, at all times only a relatively small surface suitable for the reaction, and the already reduced outer layer of the pressed article very considerably obstructs the penetration of the calcium vapor to the inside of the molded article.

It has been found as a further disadvantage that the heat liberated during the reaction is not optically carried off so that local overheating may occur. Thereby there exists the danger that the primarily produced metallic or alloy powders will grow to larger structures, agglomerate, or, in case of the occurrence of fusible phases, will be sintered together.

It is the object of the present invention to provide an apparatus with which it is possible to carry out metallothermal reactions and in which the reducing metal acts in the gaseous phase upon the material to be reduced, while the disadvantages outlined above are effectively eliminated.

It is therefore particularly an object of the present invention to provide an apparatus in which the oxide mixture to be reduced is offered to the metallic vapor acting from the gaseous phase with a large surface, but nevertheless on a small space, and whereby the metallic oxides to be reduced are rotated during the process, so that the separate manufacture of pressed articles is rendered superfluous.

It is another object of the present invention to prevent that local overheating occurs during the metallothermal reaction, but at least to insure that the reaction heat liberated is rapidly led off, so that an agglomeration or baking-together of the particles can be effectively avoided.

These objects are obtained by means of the vacuum revolving cylindrical furnace of the present invention.

Hence, the present invention is directed to a vacuum revolving cylindrical furnace composed of a. an outer housing adapted to be evacuated which, with respect to the longitudinal axis thereof, has on one end a closable filler cap and, on the opposite end, a vacuum-tight passage for a rotary shaft;

b. a rotary tube open toward the filling or feed end of the housing, and having on the opposite end thereof, a rotary shaft extending through the housing, the rotary tube being disposed in the longitudinal axis of the housing;

c. a cylindrical reaction chamber which is disposed symmetrically to the longitudinal axis of the rotary tube and connected therewith in a force-locking manner but also detachably, whereby the reaction chamber is narrowed on the filling or feed end to a tube having a small lumen, and closed off on the opposite end;

d. a cylindrical evaporation chamber, disposed in the forward area of the reaction chamber in the longitudinal axis thereof, for the metal which brings about the metallothermal reaction, and wherein the evaporation chamber has an opening on the end thereof facing the feed end;

e. a heating means surrounding the rotary tube at least within the area of the cylindrical reaction chamber, and f. means for evacuating the rotary furnace, and a drive means for the rotary tube of the rotary cylindrical furnace.

In a particularly preferred embodiment of the inventive vacuum revolving cylindrical furnace, the longitudinal axis of the rotary tube forms an angle of 5° to 25° with the horizontal, whereby the feed or charge end of the revolving tubular furnace is positioned above the reference horizontal.

It is advantageous if the rotary tube has heat insulating means outside of the heated zone.

It has been found to be particularly advantageous if the rotary tube in the rotary tubular furnace is mounted on rollers, particularly graphite rollers.

In order to assure a good heat passage, the rotary tube may have bores within the area of the heating means.

In order to prevent a reaction of the metallic vapor or of the reaction products formed with the wall material of the reaction chamber it is preferred to coat or line the inner surface of the reaction chamber with a correspondingly inert material, for example calcium oxide, magnesium oxide, or a metal sheet having suitable chemical and thermal resistance.

For the guidance of the evaporation chamber within the reaction tube, spacer means are positioned in an annular manner and at the same distance preferably at the inner wall of the reaction tube or at the outer wall of the evaporation chamber.

The inventive vacuum revolving cylindrical furnace is shown in FIG. 1 in which:

The revolving cylindrical furnace comprises a housing 1 adapted to being evacuated, whose individual parts are bolted together and the sealing elements 2 are provided for effecting a vacuum seal. By way of the stud 3 the housing of the furnace is connected with a vacuum pump. Positioned symmetrically to the longitudinal axis of the housing is a rotary tube 4 which is open at the filling side of the housing. The housing may be opened by removing the cap 5. The rotary tube 4 has, at the side facing away from the charging side, a rotary shaft 6 which is guided in a vacuum-tight manner by means of a vacuum rotary passage 7 through the housing 1 and is connected with a geared motor 8. The rotary tube 4 is mounted on the rollers 9 and annularly surrounded by the heating element 10 in whose area the rotary tube 4 is preferably perforated. Positioned in these heating elements 10 is a thermometer 11. Positioned at the inside of the rotary tube 4 symmetrically to the longitudinal axis thereof is the cylindrical reaction chamber proper 12 which is force-lockingly but detachably connected with the rotary tube 4 by means of the pin 13. The reaction chamber becomes narrowed in the forward region thereof to a tube 14 having a small lumen. In order to keep heat losses low, the reaction chamber 12 is sealed with insulating material 15 outside of the heated zones thereof.

Accommodated in the reaction chamber 12 is the cylindrical evaporation chamber 16 which is centered by means of the spacer members 17 within the reaction chamber 12. The evaporation chamber 16 has an opening 18 on the side thereof facing the charging side. On the averted side of the reaction chamber 16 there is mounted a profile rod 19 which is connected with the evaporation chamber 16 and the rear wall of the reaction chamber 12 and which secures the evaporation chamber 16 in its intended position.

The entire apparatus forms with the horizontal an angle of approximately 5°. The inclination of the revolving cylindrical furnace may be varied by means of a spindle 20.

For carrying out the metallothermal reactions, the cap 5 of the housing is opened, the hollow cylinder 15 of insulating material is removed, and the reaction chamber 12 is pulled forwardly out of the rotary tube 4. At this time, the lid 21 which constitutes the front closure of the reaction chamber 12 is removed, and the evaporation chamber 16 is lifted out of the reaction chamber 12. The metallic oxide or metallic oxide mixture 24 to be reduced — to which it is possible to additionally admix characteristic and/or foreign metallic powder either for damping the reaction or for purposes of alloying — is now charged into the inner space of the reaction chamber 12. Thereafter, the evaporation chamber 16 is re-inserted and filled with such a quantity of a metallothermally active metal 22, for example calcium in the form of a granulate, that at the desired inclination of the revolving tubular furnace the level of the molten metal is positioned below the opening 18 of the evaporation chamber 16. Thereupon the lid 21 is put on and connected with the reaction chamber 12 in a vacuum-tight manner.

After the insertion of the insulating material 15 and closing of the vacuum revolving tubular furnace by means of the cap 5, the housing of the revolving tubular furnace is evacuated to a presence of approximately $10^{-2}$ to $10^{-3}$ Torr. At the same time the rotary tube 4 is heated by means of the heating coils 10.

When calcium is used for the reduction, it melts at approximately 860° C and evaporates to a certain extent through the narrow tube 14 where, by cooling, it forms a calcium plug 23 and closes off the reaction chamber 12.

When the material to be reduced is composed, for example, of oxides of the rare earths and cobalt oxide, the metallothermal reaction occurs at temperatures of approximately 900° C and above. The rotary tube 4 and the reaction chamber 12 force-lockingly connected therewith rotates, driven by the geared motor 8, at a speed of approximately 6 to 10 revolutions per minute so that the oxide mixture 24 is continuously revolved. The amount of heat added by the heating means 10 is now kept so low that any overheating of the reaction material that might be possible by the exothermic reaction is effectively avoided. The velocity of the exothermic reaction may be controlled to a certain extent by the temperature of the heater, and therewith by the quantity of the calcium vapor available for the reaction. The quantity of calcium is thereby so proportioned that it is present stoichiometrically at a small excess with reference to the oxide mixture. After the completion of the reaction, the rotary tube 4 continues to rotate until the temperature decreases to 100° C. Protective gas is then fed into the revolving tubular furnace through the evacuation stud 3; the furnace is opened in the manner described hereinabove, and the reaction material present in loose, powdery form is removed from the reaction chamber 12. It it then freed in the usual manner from the oxide, in the present case from the calcium oxide, and fed for further treatment. The position of the reaction chamber 12 may be observed through an inspection glass 25.

With the use of the inventive apparatus one is able to successfully produce, for example, rare earth-cobalt alloys having the composition given hereunder in predominantly single-phase form with grain sizes of 1.5 to 20μm: $RECo_5$, $RE_2(CoFe)_{17}$, $RE_2Co_7$, $RECo_2$, $RECo_3$, and $RE_{60}/Co_{40}$.

For the setting of the corresponding ratio, merely the quantitatively proportional charging of the apparatus is required. As experiments have shown, the apparatus is equally suited for producing very finely powdered zironium-, titanium-, or chromium metal which is particularly well suited in this form for further treatment in powder metallurgy. The metallic powders are especially characterized by superior purity, uniform and low granulation, and by the reproducibility of the granulation.

It is further possible to obtain special alloys, such as, for example, alloys based on substituted RE-cobalt alloys, whereby the cobalt component may be partially replaced by iron, manganese, nickel, and copper, and pure two-phase alloys may be produced. Experiments also have shown the possibility of producing titanium-aluminum-vanadium alloys so that the inventive apparatus is generally usable and suitable for carrying out metallothermal reactions in which the metal serving as a reducing agent can evaporate under the reaction conditions.

The following table shows the composition and the grain size of various alloys produced with the inventive apparatus which alloys were obtained with the use of calcium from the various oxides in a yield of nearly 100%.

Composition of the powdery metals and alloys prepared in the vacuum revolving tubular furnace.

| Metal Alloy | Average grain size (μm) | Grain size range % by weight, μm | Oxygen content (ppm) | Phase constituents (Vol. - %) |
|---|---|---|---|---|
| $Sm_2(Co_{0.8}Fe_{0.2})_{17}$ | 1.6 - 2.5 μm | 100 <15 μm | 2000 - 2400 | $SmCo_5$ <1 |
| $SmCo_5$ | 4.0 - 10.0 μm | 100 < 20 μm | 1800 - 2300 | $Sm_2Co_{17}$ < 1 |
| $Sm_2Co_7$ | 5.0 - 10.0 μm | 100 < 25 μm | 2000 - 2400 | $SmCo_3$ < 2 |
| $SmCo_2$ | 10.0 - 15.0 μm | 100 < 30 μm | 2800 - 3200 | nearly single-phased |
| $SmCo_3$ | 6.0 - 10.0 μm | 100 < 15 μm | 2000 - 2500 | $SmCo_2$ < 5 |
| Sm60/Co40 | 25.0 - 33.0 μm | 100 < 40 μm | 2200 - 2600 | $SmCo_2$ + eutectic |
| Sm $(Co_{0.85}Fe_{0.1}Cu_{0.05})_8$ | 3.6 - 8.0 μm | 100 < 40 μm | 2000 - 2800 | two-phased (1 : 5 + 2 : 17) |
| $Sm(Co_{0.85}Fe_{0.1}Ni_{0.05})_8$ | 6.0 - 10.0 μm | 100 < 30 μm | 2000 - 2800 | two-phased (1 : 5 + 2 : 17) |
| $Sm(Co_{0.85}Fe_{0.1}Mn_{0.05})_8$ | 6.0 - 10.0 μm | 100 < 25 μm | 2000 - 2800 | two-phased (1 : 5 + 2 : 17) |
| Chromium metal | 3.0 - 5.0 μm | 100 < 15 μm | 2400 - 3000 | — |
| Zirconium metal | 10.0 - 20.0 μm | 100 < 40 μm | 2100 - 2500 | — |

It will be obvious to those skilled in the art that many modifications may be made within the scope of the present invention without departing from the spirit thereof, and the invention includes all such modifications.

What is claimed is:

1. A vacuum rotatable tubular furnace for metallothermal reactions comprising an outer housing adapted to be evacuated and having on one end thereof a closable filler cap, and a vacuum-tight passage for a shaft on the other end, rotatable tube means in said outer housing, said tube means being open on an end thereof facing said filler cap, and having a shaft connected to the other end of said tube and extending through said housing, a cylindrical reaction chamber mounted in said rotatable tube means symmetrically to the longitudinal axis of the latter, and being detachably connected thereto, said reaction chamber being narrowed on a filling end thereof to a tube having a small lumen and being closed at the other end thereof, a cylindrical evaporation chamber mounted in the area of the filling end of the reaction chamber and being adapted to contain metal effecting a metallothermal reaction, said evaporation chamber having an opening on an end thereof facing said filler cap, heating means on said rotatable tube means at least within the area of the cylindrical reaction chamber, means for evacuating the rotatable furnace, and drive means for rotating said rotatable tube means.

2. A furnace according to claim 1 in which the rotatable tube means forms an angle of about 5° to 25° with the horizontal, whereby the filler cap end of the housing also is above the horizontal.

3. A furnace according to claim 1 including heat insulating means outside of the heated area of the rotatable tube means.

4. A furnace according to claim 1 including bore means in said rotatable tube means where said tube means is heated.

5. A furnace acording to claim 1 including roller means supporting said rotatable tube means.

6. A furnace according to claim 5 in which said roller means are graphite.

7. A furnace according to claim 1 including lining means in said reaction chamber, said lining means being inert with respect to reactants and reaction products.

8. A furnace according to claim 1 including annular spacer means between the interior of the reaction chamber and the exterior of the evaporation chamber.

* * * * *